US010100834B2

(12) United States Patent
Bissell et al.

(10) Patent No.: US 10,100,834 B2
(45) Date of Patent: Oct. 16, 2018

(54) LIQUID RING PUMP PORT MEMBER HAVING ANTI-CAVITATION CONSTRUCTIONS

(71) Applicant: GARDNER DENVER NASH LLC, Charleroi, PA (US)

(72) Inventors: Douglas Eric Bissell, Monroe, CT (US); Wilson Fabian Gaibor, Belle Vernon, PA (US)

(73) Assignee: GARDNER DENVER NASH LLC, Charleroi, PA (US)

( * ) Notice: Subject to any disclaimer, the term of this patent is extended or adjusted under 35 U.S.C. 154(b) by 303 days.

(21) Appl. No.: 15/041,688

(22) Filed: Feb. 11, 2016

(65) Prior Publication Data

US 2016/0238008 A1 Aug. 18, 2016

Related U.S. Application Data

(60) Provisional application No. 62/115,408, filed on Feb. 12, 2015.

(51) Int. Cl.
*F04C 19/00* (2006.01)
*F04C 29/12* (2006.01)

(52) U.S. Cl.
CPC ..... *F04C 19/008* (2013.01); *F04C 29/12* (2013.01); *F04C 2240/30* (2013.01)

(58) Field of Classification Search
CPC ..... F04B 19/00; F04B 19/004; F04B 19/005; F04B 19/008; F04B 29/12; F04B 2240/30
USPC ..... 417/68
See application file for complete search history.

(56) References Cited

U.S. PATENT DOCUMENTS 3,575,532 A 4/1971 Mugele et al.
4,083,658 A * 4/1978 Ramm ..... F04C 19/005 417/68
4,521,161 A * 6/1985 Olsen ..... F04C 19/008 417/68
4,634,348 A * 1/1987 Auschrat ..... F04C 29/122 417/68
4,850,808 A 7/1989 Schultze et al.
(Continued)

OTHER PUBLICATIONS

PCT International Search Report and Written Opinion for Application No. PCT/US16/17589 dated May 19, 2016 (12 pages).

*Primary Examiner* — Charles Freay
(74) *Attorney, Agent, or Firm* — Michael Best & Friedrich LLP

(57) ABSTRACT

A pump includes a housing that contains a liquid, and a rotor including a plurality of blades extending radially from a shaft, and defining a conical space. A port member is disposed within the conical space. The port member defines an inlet port in communication with a low pressure region, a discharge port in communication with a high pressure region, and an anti-cavitation port in communication with a fluid supply having a pressure between the low and the high pressure regions. Each pair of adjacent blades cooperates with the liquid and the port member to enclose a variable volume bucket, wherein rotation of the rotor selectively positions a bucket in an inlet position adjacent the inlet port to draw in fluid, in an anti-cavitation position wherein the bucket is adjacent the anti-cavitation port and fluid is admitted into the bucket, and a discharge position wherein the bucket is positioned adjacent the discharge port to discharge fluid.

20 Claims, 7 Drawing Sheets

(56) References Cited

U.S. PATENT DOCUMENTS

| | | | | |
|---|---|---|---|---|
| 5,246,348 | A * | 9/1993 | Wallace | F04C 19/008 417/68 |
| 6,585,492 | B2 | 7/2003 | Muhs et al. | |
| 8,366,883 | B2 * | 2/2013 | Bednarek | B01D 1/221 159/24.1 |

* cited by examiner

LIQUID RING PUMP PORT MEMBER HAVING ANTI-CAVITATION CONSTRUCTIONS

RELATED APPLICATION DATA

This application claims priority to U.S. Provisional Application No. 62/115,408 filed Feb. 12, 2015, the contents of which are fully incorporated herein by reference pump.

BACKGROUND

The disclosure concerns anti-cavitation constructions of a liquid ring pump.

Liquid ring pumps and their operation are well known. In general liquid ring pumps utilize a liquid ring which, during operation, delimits a pumping chamber. The pumping chamber can comprise one or multiple lobes. A shaft rotates a rotor. The liquid ring is eccentric. During operation of the pump a radial inward surface of the liquid ring is radially spaced from the shaft at an intake zone to allow buckets formed by adjacent blades of the rotor to fill with gas entering the pump's pumping chamber through an inlet port. The inlet port is downstream of a pump head inlet. The buckets fill with gas as they sweep past the inlet port. An inlet port channel extends from the inlet port and provides a fluid connection between the pump head inlet and the inlet port.

The radial inward surface of the liquid ring in a compression zone of the pump is oriented relative to the shaft to compress the gas in the buckets and force the gas through an outlet port which leads to an outlet of the pump. An outlet port channel extends from the outlet port and provides a fluid connection between the outlet port and the pump head outlet.

The ring compresses the gas in the buckets because of its eccentric orientation. The orientation means the radially inward surface of the liquid ring has a much closer approach to the axis of the shaft in the radial direction along the compression zone as compared to its approach along the intake zone.

During operation of the pump, sealing liquid is introduced into the buckets. The sealing liquid enters a bucket of the pump through a sealing liquid introduction port formed in the outer sidewall. A sealing liquid introduction channel extends to the sealing liquid introduction port and provides a fluid connection between a pump head sealing liquid inlet to the sealing liquid introduction port. The sealing liquid enters the buckets from the sealing liquid introduction port. The sealing liquid fills interstices and otherwise allows for proper operation of the pump such as replenishing the liquid forming the liquid ring.

The sealing liquid in the bucket can cause cavitation of the blades and in particular at the base of a leading side of a trailing blade forming the bucket. To reduce the damage caused by cavitation, the art has used material resistant to cavitation. The art has also used diverters proximate the sealing liquid introduction port in the port member to reduce cavitation. U.S. Pat. No. 4,498,844, Bissell provides a comprehensive description of how a liquid ring pump having a conical or cylindrical port member operates and some of its basic structure and is hereby fully incorporated by reference.

SUMMARY

An example of the invention is embodied by a liquid ring pump. The pump has a pump head. The pump head has a gas pump head inlet opening through an external portion of the pump head and has a gas intake channel in a portion of said pump head. The gas intake channel is open to the pump head gas inlet. The pump further has a pumping chamber housing forming a chamber. A rotor is in the chamber. The rotor has a plurality of blades which form a plurality of buckets. A port member is in a cavity formed said plurality blades. The port member has a first sidewall disposed around a second sidewall. A gas inlet port and a gas outlet port are formed in the first sidewall of the port member. The gas inlet port and gas outlet port are in the cavity. An anti-cavitation passage has a gas opening through an exterior facing surface of the first sidewall. The opening is in the cavity. The anti-cavitation passage has a gas entry which opens through a surface of said port member. The entry is outside of said buckets and the entry is separated from gas discharge from any of said buckets. The entry is separated from the pump head gas intake channel. The anti-cavitation passage opening is separated from said gas inlet port.

The port member can further have a sealing liquid introduction port which opens through the first sidewall. A sealing liquid introduction channel in said port member is open to the sealing liquid introduction port. The sealing liquid introduction channel comprises walls which each extend along a first axis in a direction away from the first sidewall exterior surface towards the central axis of the port member. The walls also each extend along a second axis in a direction away a second open end of the port member towards a first open end of the port member. Each wall, along its second axis, is angled relative to a plane passing through an area of the sealing liquid introduction port opening through the first sidewall. The plane extends along the central axis and is parallel thereto. The angle is preferably 10 degrees±2 degrees. The area of the sealing liquid introduction port opening through the first sidewall can have a rim which comprises a chamfered surface. A sealing liquid diverter can be proximate the introduction port.

Accordingly summarized even further, the port member in the cavity of the rotor of the liquid ring pump has the anti-cavitation passage. The passage has a gas opening through an exterior facing surface of the first sidewall of the port member. The opening is in the cavity. The gas entry of the ant-cavitation passage opens through the surface of said port member. The entry is outside of buckets formed by blades of the rotor and is separated from the gas discharge from any of said buckets. The entry is separated from the pump head gas intake channel of the liquid ring pump. The anti-cavitation passage opening is separated from said gas inlet port. The sealing liquid introduction port opens through the first sidewall. The sealing liquid introduction channel opens to the sealing liquid introduction port and has walls angled relative to a plane passing through an area of the sealing liquid introduction port opening through the first sidewall. The plane extends along a central axis and is parallel thereto.

The following detailed description and above summary and the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is delimited by the appended claims. The description, therefore, is not to be taken in a limiting sense and shall not limit the scope of equivalents to the invention.

In one aspect, a liquid ring pump includes a pump head having an inlet opening, an outlet opening, and an anti-cavitation opening, a pump housing coupled to the pump head and defining a chamber that is substantially enclosed by the pump housing and the pump head, and a rotor at least partially disposed in the chamber. A port member is disposed in the chamber and positioned adjacent the rotor. The port member includes a wall that defines an inlet port, a discharge port, and an anti-cavitation port each separate from the others. A plurality of blades is arranged around a rotational axis of the rotor, wherein each pair of adjacent blades partially define a bucket therebetween. Each bucket rotates from a first position in which the bucket is positioned between the discharge port and the inlet port, to a second position in which the bucket is in fluid communication with the inlet port to draw fluid into the bucket, to a third position in which the bucket is in fluid communication with the anti-cavitation port to admit fluid, to a fourth position in which the bucket is in fluid communication with the anti-cavitation port and the discharge port, and to a fifth position in which the bucket is in fluid communication with the discharge port to discharge the fluid within the bucket.

In another aspect, a liquid ring pump includes a pump housing defining a chamber that is substantially enclosed and that contains a quantity of liquid, and a rotor at least partially disposed in the chamber and including a shaft supported for rotation about a rotational axis and a plurality of blades extending radially from the shaft, the plurality of blades defining a conical interior space. A port member is disposed at least partially within the conical interior space. The port member defines an inlet port in fluid communication with a low pressure region, a discharge port in fluid communication with a high pressure region, and an anti-cavitation port in fluid communication with a fluid supply having a pressure between the low pressure region and the high pressure region. The plurality of blades is arranged such that each pair of adjacent blades cooperates with the liquid and the port member to substantially enclose and define a variable volume bucket, wherein rotation of the rotor selectively positions a first bucket of the plurality of buckets in an inlet position adjacent the inlet port to draw low pressure fluid into the bucket, in an anti-cavitation position wherein the bucket is adjacent the anti-cavitation port and fluid is admitted into the first bucket, and a discharge position wherein the first bucket is positioned adjacent the discharge port to discharge fluid from the bucket to the high pressure region.

In yet another aspect, a method of reducing cavitation in a liquid ring pump includes defining a plurality of buckets between adjacent blades of a rotor, forming a liquid ring around the blades, the liquid ring and the blades cooperating to enclose each of the buckets such that as the buckets rotate about a rotational axis the volume within each bucket varies as a result of movement of the liquid ring with respect to the rotor, and rotating a first of the plurality of buckets to a closed position wherein the bucket is substantially sealed and the volume of the bucket is at a minimum volume. The method also includes rotating the first of the plurality of buckets to an intake position in which the bucket is in fluid communication with an inlet port, maintaining fluid communication between the first bucket and the inlet port during further rotation of the bucket during which the liquid ring moves radially away from the rotational axis with respect to the first bucket to expand the volume of the first bucket and draw fluid into the volume via the inlet port, and rotating the first of the plurality of buckets to an anti-cavitation position wherein an anti-cavitation port is in fluid communication with the first bucket. The method further includes admitting a flow of fluid into the first bucket via the anti-cavitation port to increase the pressure within the first bucket, rotating the bucket to a full discharge position in which the first bucket is in fluid communication with a discharge port and is not in fluid communication with the anti-cavitation port, and maintaining fluid communication between the first bucket and the discharge port during further rotation of the first bucket during which the liquid ring moves radially toward the rotational axis with respect to the first bucket to reduce the volume of the first bucket and discharge fluid from the volume via the discharge port.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1A:
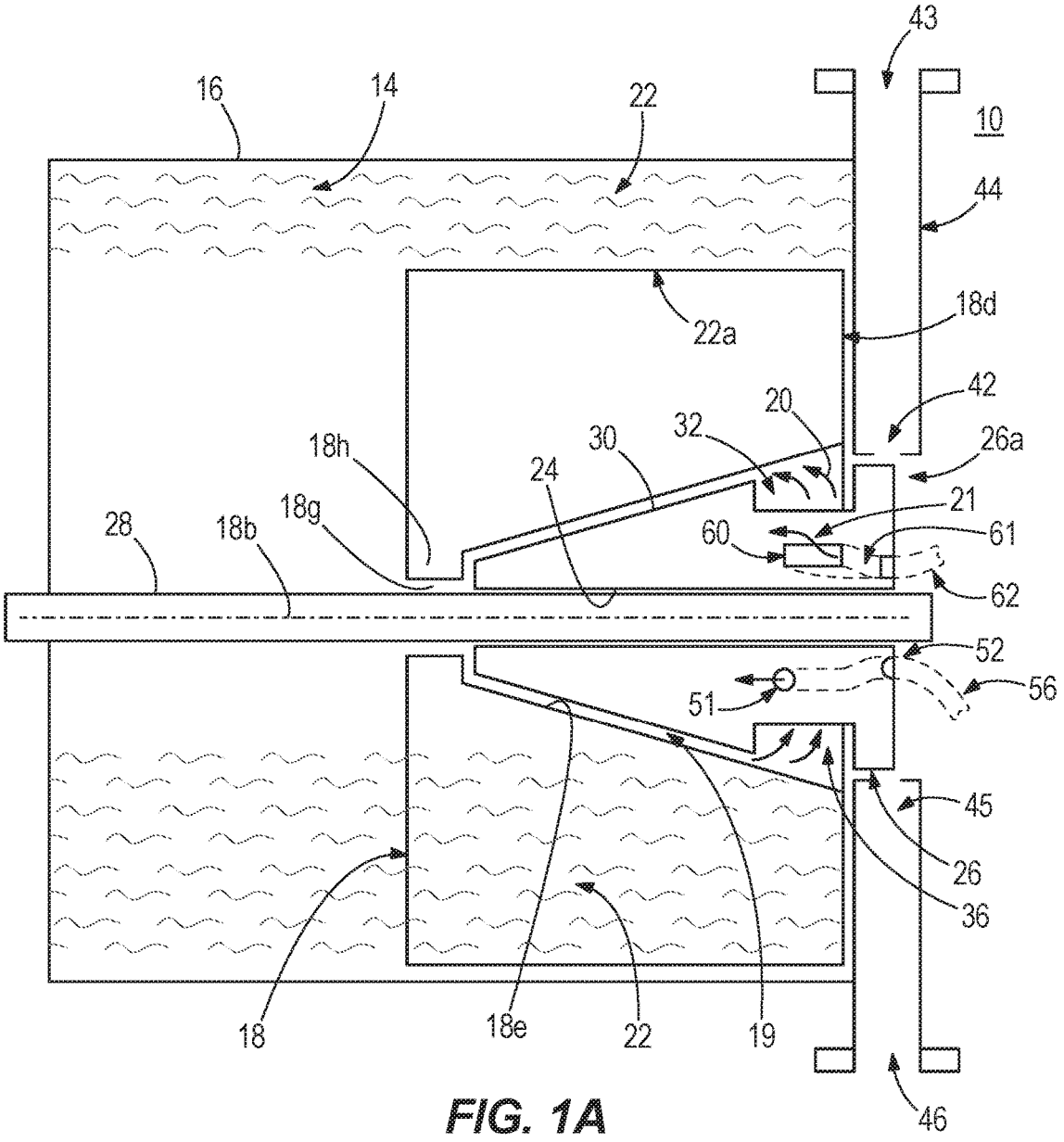
FIG. 1*a* is a side schematic irregular view of a liquid ring pump illustrating features of the invention; the schematic shows a port member in a cavity of a rotor; the rotor is in a housing, and the housing is coupled to a pump head.
Figure 1B:
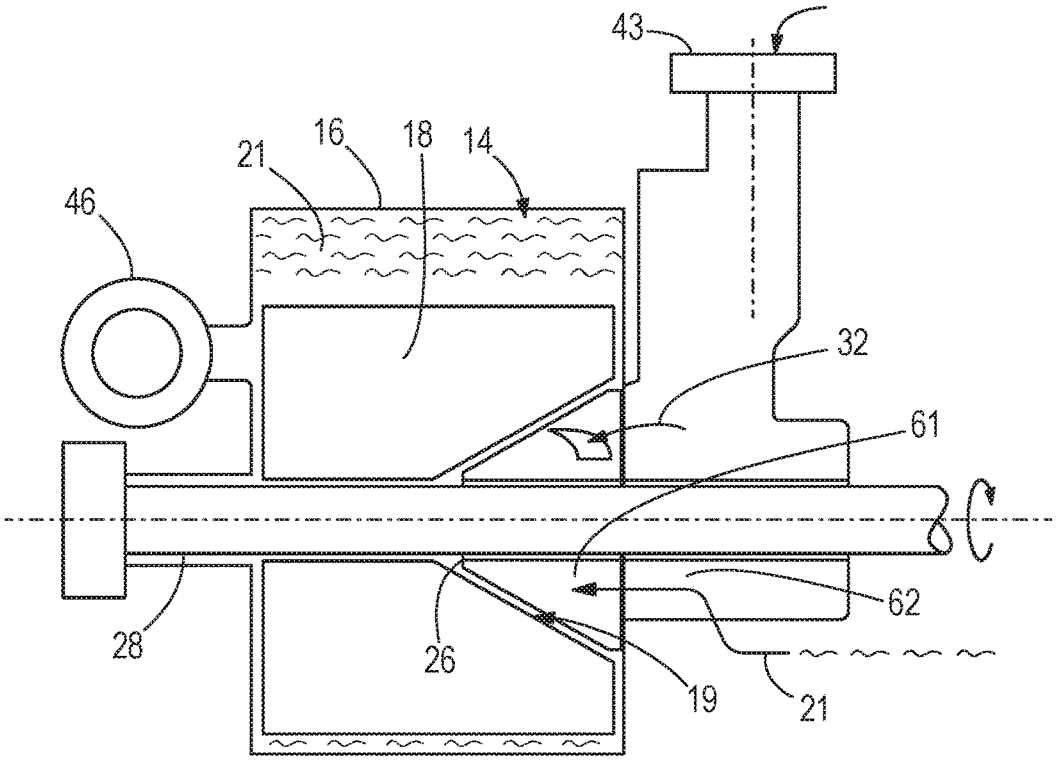
FIG. 1*b* is a side schematic view of a liquid ring pump illustrating the location of a gas inlet port relative to a pump head, rotors and housing of a liquid ring pump which embodies the features of the present invention.
Figure 1C:
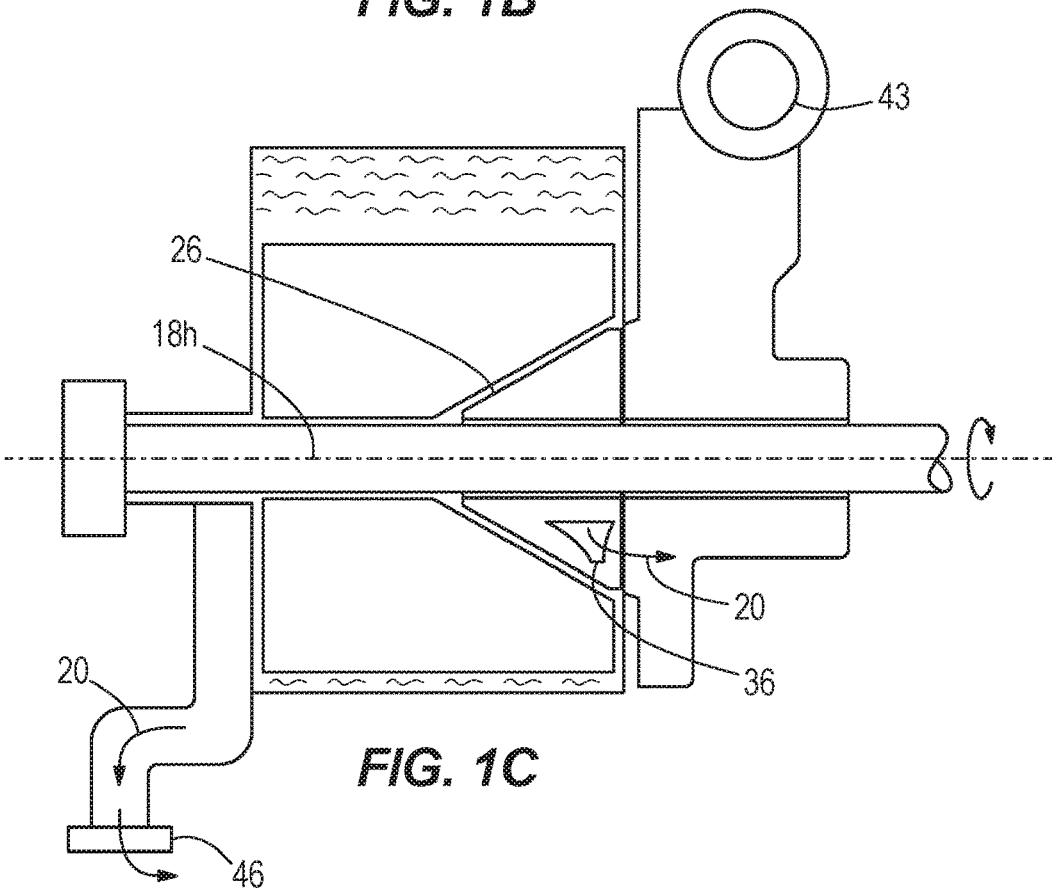
FIG. 1*c* is a side schematic view of a liquid ring pump illustrating the location of a gas discharge port relative to a pump head, rotors and housing of a liquid ring pump which embodies the features of the present invention.

As illustrated in FIG. 1*a*, a liquid ring pump 10 includes a chamber 14 formed by a pumping chamber housing 16. A rotor 18 in the pumping chamber to pump the gas 20 has a plurality of blades 18*a* which are arranged around a central area of the rotor. More particularly they are arranged circumferentially about the rotor's central axis 18*b*. The blades 18*a* are equidistantly spaced from each other. Between each pair of adjacent blades is a space which can be called a bucket 18*c*. There is a plurality of buckets 18*c* arranged around the rotor central axis 18*b*. Each bucket 18*c*, when the liquid ring pump is operating at its running speed, forms a separate sealed bucket 18*c* sealed by liquid of a liquid ring 22. The sealed bucket 18*c* has a void space (volume) which expands and contracts depending on the angular orientation of the bucket 18*c* relative to an inner surface 22*a* of the rotating liquid ring 22 in the chamber. The inner surface 22*a* of the liquid ring delimits a radial inner boundary of the liquid ring 22 and forms a radial outer boundary of a respective sealed bucket 18*c*. The radial inward boundary of each sealed bucket 18*c* is formed by an exterior facing surface 24*a* of a second sidewall 24 of a port member 26. Each sealed bucket can be called a compressible fluid chamber.

Each rotor blade 18*a* has a first free end 18*d* which extends in a radial direction relative to the central axis of the rotor. Each rotor blade has a second free end 18*e* extending in an axial direction relative to the rotor central axis 18*b*. Each second free end 18*e* is either inclined or parallel relative to the rotor central axis 18*b*. In the present example they are inclined. Each blade's first and second free ends intersect with each other. The second free ends form a cavity 19. The rotor is fixedly connected to a shaft 28. The shaft extends through the cavity 19 and through a shaft receiving aperture 18*g* formed by a hub 18*h* of the rotor 18.

The port member 26 is in the cavity 19. The port member 26 has a first sidewall 30 in the cavity 19. The first sidewall 30 is elongated in a first direction. The first direction is a direction away from a first open end 26*a* of the port member towards a second open end of the port member 26*b*. The first sidewall 30 extends in the first direction and is between the first open end 26*a* and second open end 26*b*. The first sidewall 30 is an outer sidewall and can be called a port wall. The first sidewall is disposed around the second sidewall 24. The second sidewall 24 is an inner sidewall. The inner sidewall 24 forms a shaft receiving hollow 24*b*. The shaft 28 extends into the hollow 24*b*.

Figure 7:
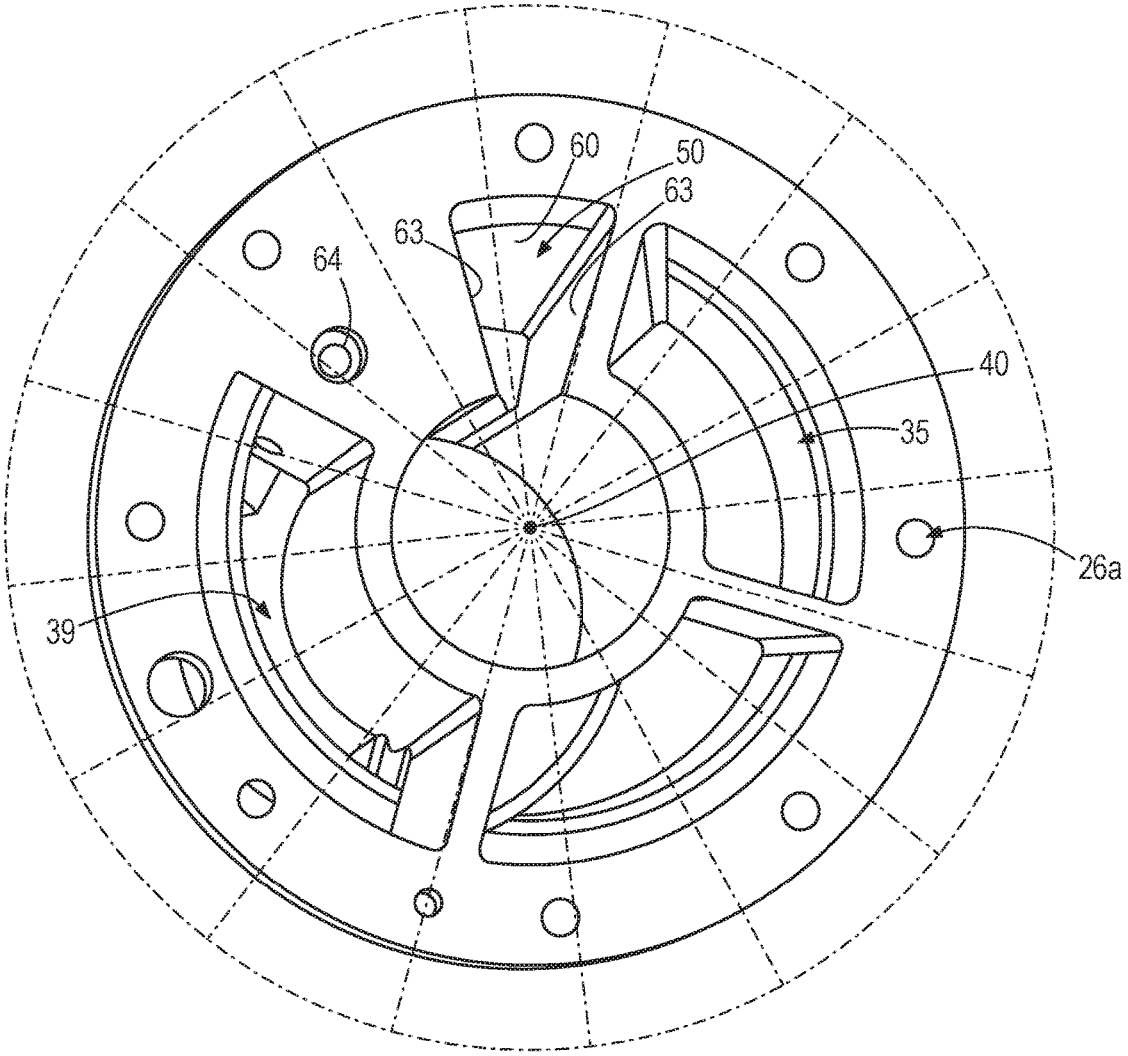
FIG. 7 is a rear isometric view of the port member of FIG. 4.

The port member 26 has a gas inlet port 32 and a gas discharge port 36 formed in the first sidewall 30. The gas inlet port 32 opens through the first sidewall 30. The gas discharge port 36 opens through the first sidewall 30. The inlet port 32 and discharge port 36 each has a respective beginning end 33, 37. Each respective beginning end 33, 37 is spaced, in the circumferential direction from a respective closing end 34, 38. The beginning end 37 of the discharge port is spaced from the closing end 38 of the gas discharge port. The beginning end 33 of the gas inlet is spaced from the closing end 34 of the gas inlet port. The beginning ends 33, 37 of the inlet port and gas discharge port each comprise a beginning edge and the closing ends 34, 38 of the gas inlet port and gas outlet port each comprise a closing edge. A portion of an interior surface 30*a* of the first sidewall 30 delimits in a second direction a gas inlet port channel 35 (shown in FIG. 7). The second direction is a direction going outward in a radial direction from the central axis of the port member. The gas inlet port channel 35 extends from and opens through the first open end 26*a* of the port member to the gas inlet port 32. The gas inlet port 32 is open to the gas inlet port channel 35. The gas inlet port channel 35 provides a gas flow connection between a gas intake channel 42 in the pump head 44 and the gas inlet port 32. The gas inlet port channel 35 is open to the gas intake channel 42 in the pump head. The pump head gas intake channel 42 is open to a pump head inlet 43. The pump head inlet 43 opens into the pump head 44.

A portion of the interior surface 30*a* of the first sidewall 30 delimits in the second direction a gas discharge channel 39. The gas discharge channel 39 extends from the outlet port to and through the first end 26*a* of the port member 26. The gas discharge port 36 is open to the gas discharge channel 39. The gas discharge channel 39 provides a gas flow connection to a gas discharge channel 45 in the pump head. The pump head gas discharge channel 45 is open to port member gas discharge channel 39. The pump head gas discharge channel 45 is open to a pump head gas outlet 46. The gas outlet 46 opens out of the pump head.

Figure 6:
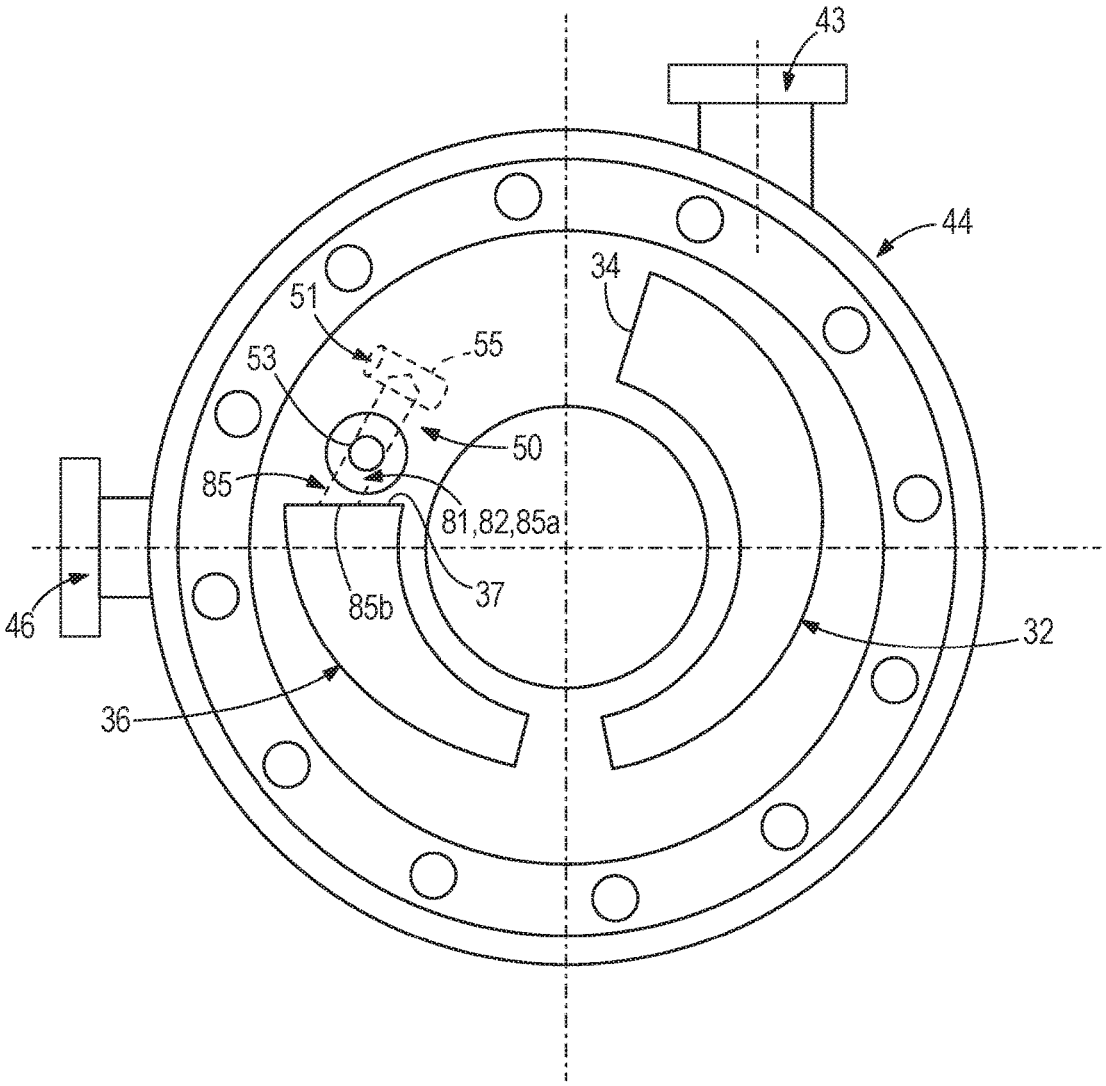
FIG. 6 is a rear schematic view of the port member of FIG. 4 in combination with a pump head of the liquid ring pump embodying features of the present invention.

The port member 26 has an anti-cavitation passage 50 (shown in FIGS. 6 and 7) comprising a gas opening 51 which opens through an exterior surface 30*b* of the first sidewall 30. The anti-cavitation gas opening 51 is an exit for the anti-cavitation passage. The anti-cavitation passage gas opening 51 is in gas flow connection with a gas entry 52 of the anti-cavitation passage 50. The gas entry 52 is in the port member 26. The gas entry 52 is not in receiving flow connection or receiving gas discharge connection with any bucket 18*c* in the chamber 14. The entry 52 is outside of the buckets 18*c*. The gas entry 52 is in flow connection with a gas supply channel 56. It is open to the gas supply channel 56. The gas supply channel is outside of said pumping chamber. It can extend through the pump head 44. The gas supply channel 56 is not open to the pump head gas inlet 43 or pump head intake channel 42. It is separated from, including fluidly separated from, the pump head gas intake channel 42 and pump head inlet 43. The gas supply channel 56 receives gas from a source external to the pumping chamber and the pump head. The gas supply channel 56 and the anti-cavitation passage 50 are continuous. The anti-cavitation passage is not open to the gas inlet port channel 35 or gas inlet port 32. The anti-cavitation passage is separated from, including fluidly separated from items 35, 32. The gas source for the gas supply channel 56 can be ambient air in the environment surrounding the chamber 14 and pump head 44. Further details of the anti-cavitation passage are explained in more detail below.

The port member 26 also has a sealing liquid introduction port 60 which opens through the first sidewall 30. The sealing liquid introduction port 60 is oriented in the circumferential direction of rotation of the rotor between the closing end 34 of the gas inlet port 32 and the beginning end 37 of the gas discharge port 36. The sealing liquid introduction port 60 is open to a sealing liquid introduction channel 61 of the port member 26. The sealing liquid introduction channel 61 provides a flow connection to a sealing liquid supply channel 62. The sealing liquid introduction channel 61 is open to the sealing liquid supply channel 62. The sealing liquid supply channel 62 can extend through the pump and in particular the pump head. The sealing liquid introduction channel 61 of the port member comprises walls 63 which extend in a direction away from the first sidewall exterior surface 30*b* towards the central axis 40 of the port member. The walls are connected with the second sidewall 24 and the first sidewall 30. The sealing liquid introduction channel 61 opens through the second sidewall 24 and is open to the shaft 28. The sealing liquid introduction channel 61 extends from and opens through the first open end 26*a* of the port member to the sealing liquid introduction port 60. The sealing liquid 21 enters the buckets 18*c* from the sealing liquid introduction port 60 as the buckets 18*c* sweep past the sealing liquid introduction port in the circumferential direction of rotation. The sealing liquid fills interstices and otherwise allows for proper operation of the pump.

Figure 2:
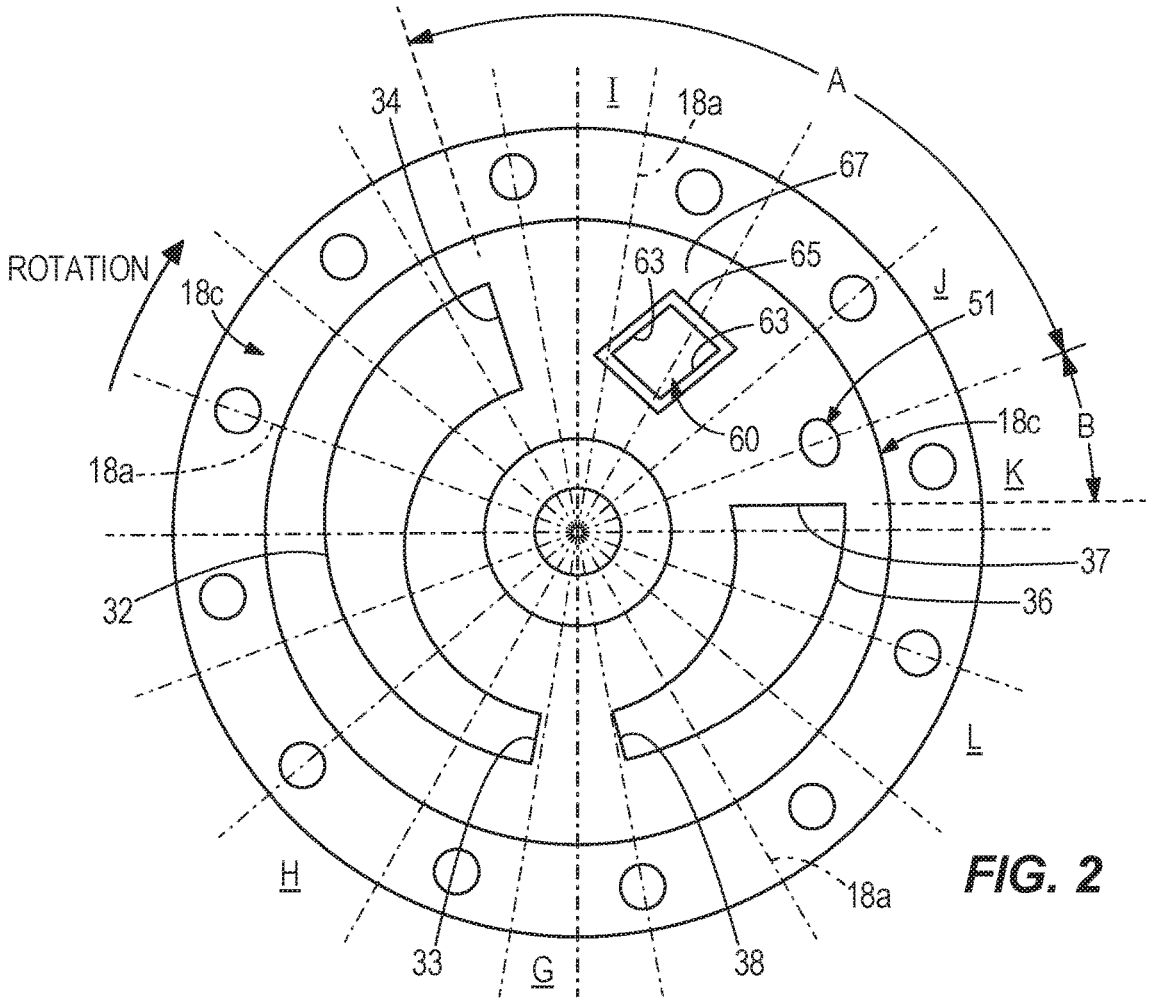
FIG. 2 is a front schematic view of a port member and a rotor of a liquid ring pump embodying features of the present invention.
Figure 3:
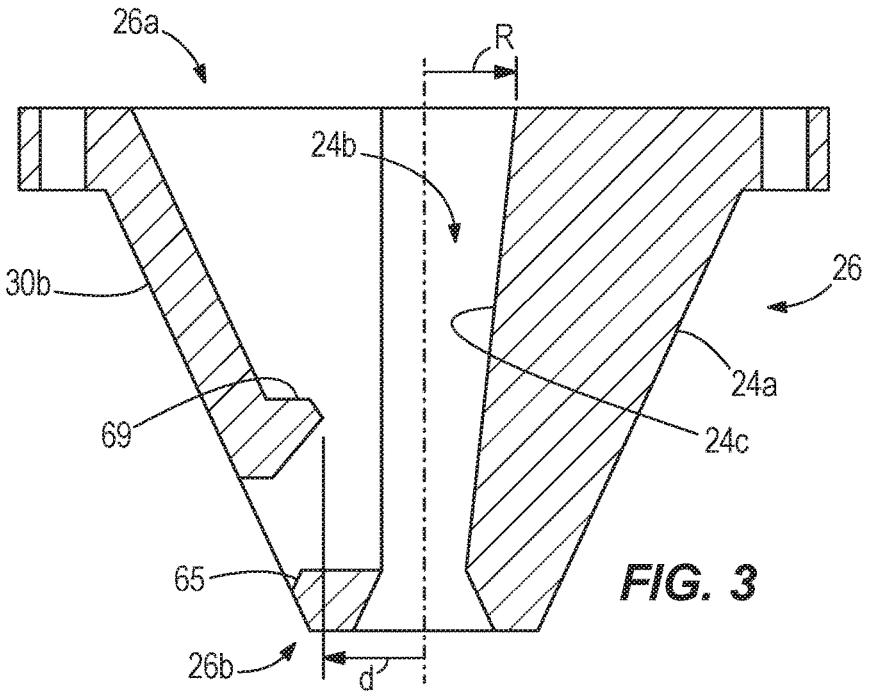
FIG. 3 is a sectional view of the port member shown in FIG. 2; the section is taken along the central axis of the port member.
Figure 4:
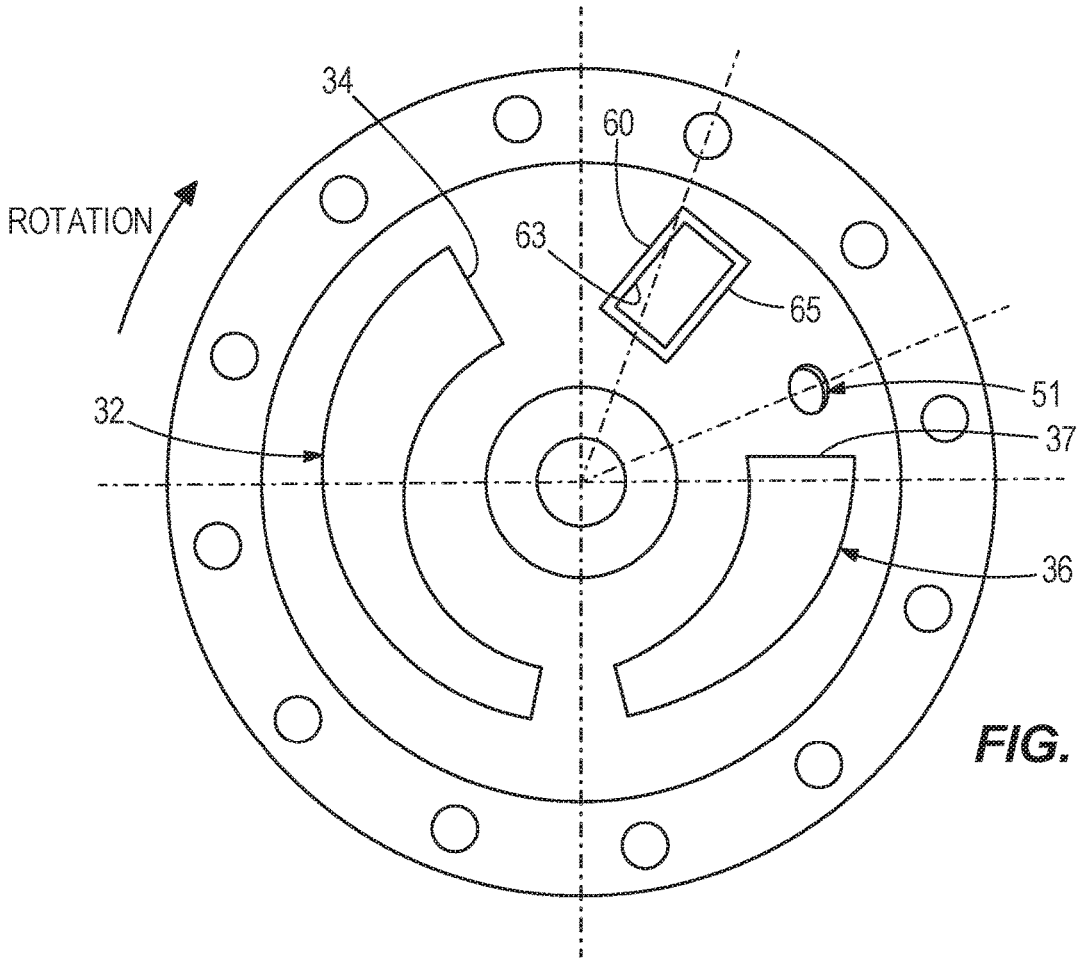
FIG. 4 is a front schematic view of the port member shown in FIG. 2 illustrating certain angles.
Figure 5:
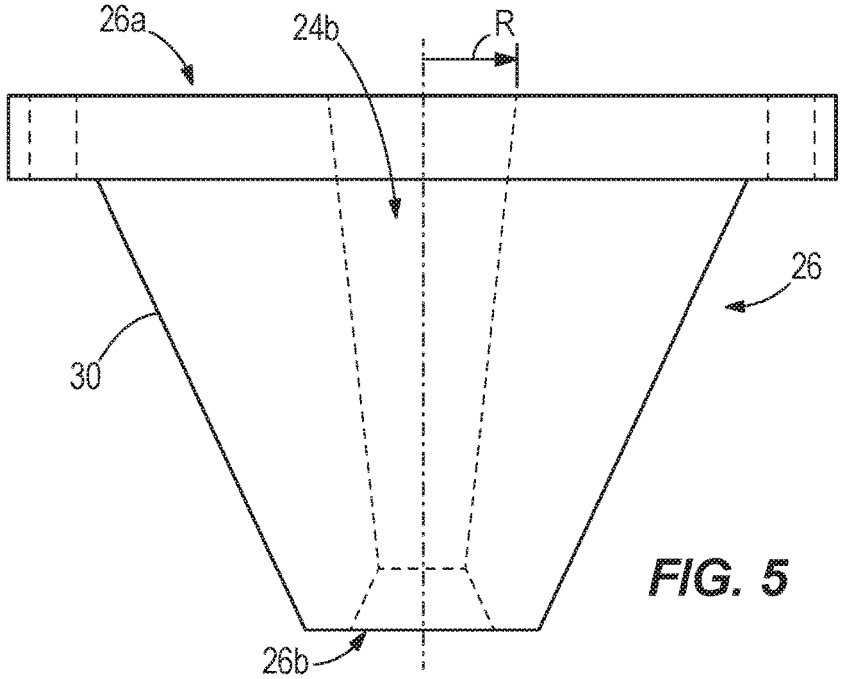
FIG. 5 is a side view of the port member shown in FIG. 4 illustrating the inner diameter of the second sidewall of the port member.

In operation, a sealed bucket 18*c* rotates to a position K (as shown in FIG. 2) wherein it is in a gas flow receiving connection with said anti-cavitation exit 51. In the position K the sealed bucket is open to the anti-cavitation exit 51. The exit 51 opens into the sealed bucket 18*c*. The bucket when in the position K is in a gas flow discharge connection with said gas discharge port 36. The bucket 18*c* is open to the gas discharge port 36. In the position K the bucket is not in a gas flow receiving connection with said gas inlet port 32 or gas inlet port channel 35. It is not open to the gas inlet port 32 or gas inlet channel 35. It has swept completely past the gas inlet port 32. In the position K it is not open to the sealing liquid introduction port 60. At least a portion of the bucket is circumferentially between the closing end 34 of said gas inlet port and the beginning end 37 of said gas discharge port. When the bucket is in the position K the external supply of gas has entered the anti-cavitation passage 50 through the entry 52 without having first flowed through the gas inlet port 32. The gas in the anti-cavitation passage is passing through said anti-cavitation opening 51 into said sealed bucket 18*c* without having first passed through the gas inlet port 32. The flow into the bucket increases the volume of gas and pressure in the bucket. Thus the bucket in the position K has an increased gas volume and increased gas pressure from gas received from said anti-cavitation passage 50. The gas received from said passage is from the external gas source. The gas is received without said gas first passing through the gas inlet port 32.

The area of the sealing liquid introduction port 60 opening through the first side wall is delimited by a rim 65. The rim comprises a chamfered surface. The chamfered surface is seamless with the first sidewall and part of the first sidewall 30. The surface can be a continuous perimeter. The surface delimits at least one half of the perimeter's length. The sealing liquid introduction channel 61 is open to the shaft 28. The walls 63 of the sealing liquid introduction channel are angled relative to a plane 67 passing through the area of the sealing inlet port opening through the first side wall and more particularly the area opening through the external surface 30*b* of the first sidewall. The plane passing through extends along the central axis 40 of the port member and is parallel thereto. The walls are each angled in a direction going away from a first end of the wall distal the first end 26*a* to a second end of the wall proximate the first end 26*a*. Thus a shortest straight line extending from the first end of the wall to the second end of the wall is angled relative to the plane 67. The walls, along the line, are each angled 10 degrees±2 relative to the plane. The walls along an axis extending along the line area angled relative to the plane in the same amount. The walls can be considered to have been rotated 10 degrees±2 degrees in the circumferential direction of rotation from a prior position relative to the plane. In the prior position, in the direction from the first end to the second end, the walls extend parallel to the plane. The angled walls 63 lesson the pressure drop in the bucket because the angled walls direct the sealing liquid through the sealing liquid introduction port at an angle relative to the plane 67. The angled flow lessons the velocity of the sealing liquid thus increasing the pressure in the bucket. The chamfered rim 65 operates on the same principal.

Proximate the sealing liquid introduction port 60 is a diverter 69 having an interference orientation to a flow of the sealing liquid 21. The interference is before the liquid passes through the sealing liquid introduction port 60. The diverter 69 breaks up the sealing liquid 21 thus decreasing the velocity of the liquid running along a leading surface of a trailing blade delimiting the bucket as it sweeps past the sealing liquid introduction port. The resulting decrease in velocity increases the pressure in the bucket and thus lessons the pressure drop in the bucket and thus the cavitation at the base of the leading surface of the trailing blade.

In more detail, the anti-cavitation passage 50 comprises a channel having a first portion 53 and a second portion 55. The first portion comprises the gas entry 52 to the anti-cavitation passage of the port member. The gas entry 52 opens through a surface of the port member 26. The surface can be a face surface at the first open end 26*a* of the port member. The face surface faces the pump head 44 when the port member 26 is connected to the pump head. The gas entry is configured to couple to the gas supply channel 56. The first portion extends in the first direction. The first portion does not open though the interior facing surface 30*a* of the first sidewall 30. It does not open into the gas inlet port channel 35 or discharge channel 39. It extends in the first direction within additional structure 71 of the port member 26. The structure 71 is between interior surface 24*c* of said second side wall 24 and said exterior surface 30*b* of said first sidewall 30. The additional structure can be considered a portion of the first sidewall 30 having increased thickness in a direction away from the exterior surface of first sidewall towards the central axis of the port member. The direction comprises a radial direction away from the first sidewall exterior surface towards the central axis of the port member. The structure can be a portion which extends from the first sidewall 30 to the second sidewall 24. The structure can delimit the gas discharge channel 39 in a circumferential direction opposite the direction of rotation. The additional structure 71 has a length measured in a direction going away from the first open end 26*a* of the port member towards the second open end 26*b* of the port member along the central axis less than a length of the gas discharge port 36 measured along the central axis. The length of the gas discharge port 36 is measured from a first end 73 of the opening of the discharge port 36 through the exterior surface 30*b* most proximate the port member first end 26*a* to a second end 75 of the opening of the discharge port 36 most distal the port member first end 26*a*. The length of the additional structure is at least 1.5 and more preferably about 2 times the length of the gas discharge port.

The second portion 55 of the channel comprises the opening (exit) 51 of the passage 50. The first portion 53 opens into the second portion 55. The second portion does not open through the interior surface 30*a* of the first sidewall. The first and second portions are in gas flow connection and continuous with each other.

The anti-cavitation passage does not open through the interior surface 30*a* of the first sidewall 30. It does not open into the inlet port 32 or inlet port channel 35. Excepting the entry, it does not open through a surface of the additional structure 71. The passage 50 is separated from, including fluidly separated from, the gas inlet port 32, gas inlet port channel 35, gas discharge port 36 and gas discharge channel 39. A bucket 18*c*, when in position K, can couple exit 51 to the discharge port 36.

Figure 8:
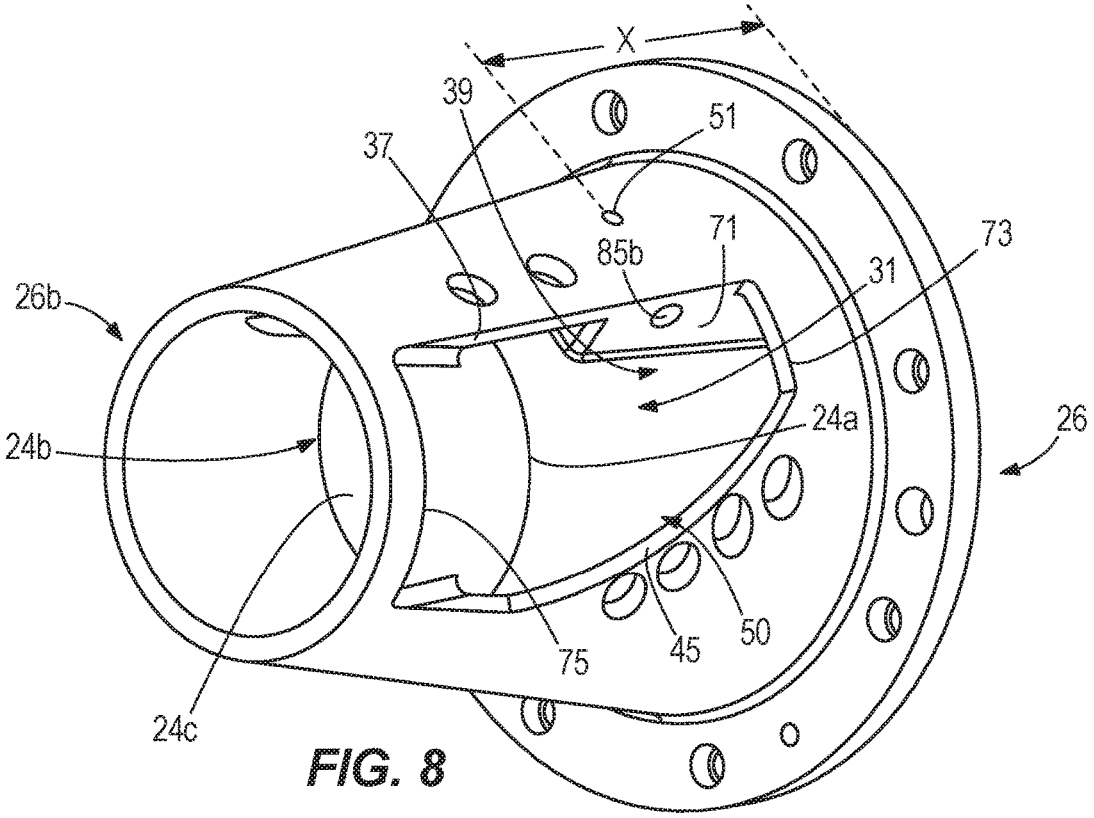
FIG. 8 is a side isometric view of the port member of FIG. 4.
Figure 9:
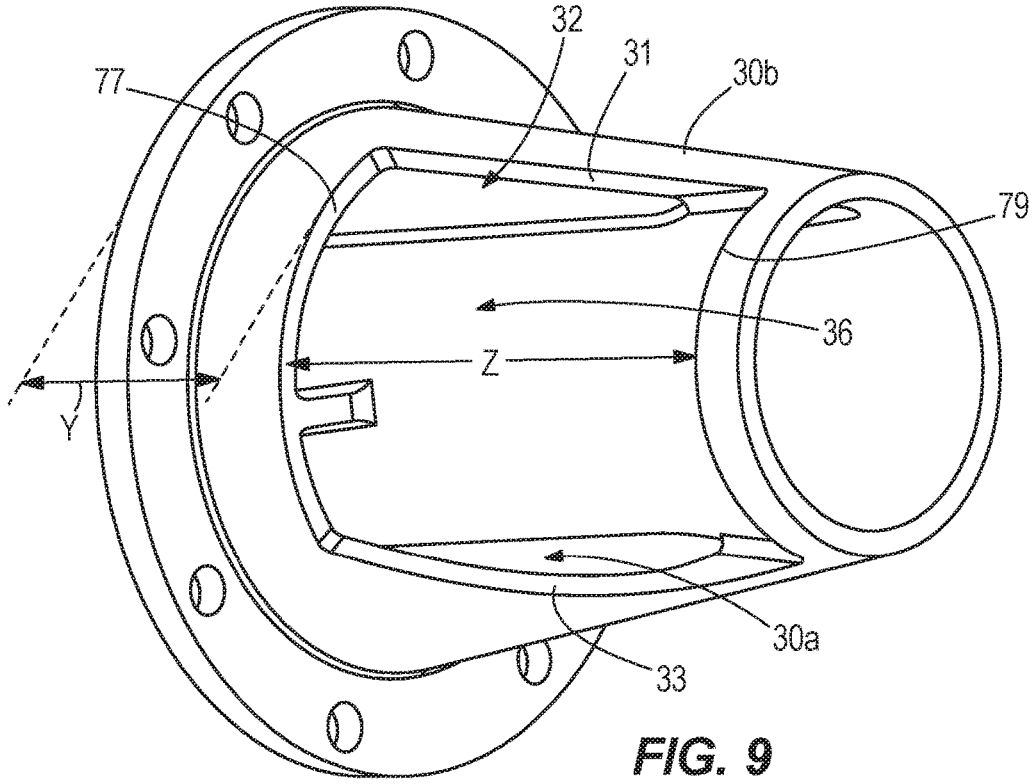
FIG. 9 is a side isometric view of the port member of FIG. 4 different from the side view in FIG. 8.

As shown in FIGS. 8 and 9, the opening 51 (more particularly the midpoint of the opening 51) of the anti-cavitation passage 50 is an axial distance X from the first open end 26*a*. The axial distance is measured along the central axis of the port member 26. The distance X is greater than the axial distance Y from the first end 26*a* of the port member 26 to an end 77 of the gas inlet port 32 most proximate the first open end 26*a* of the port member. Preferably the distance is minimized. The distance Y is measured along the central axis of the port member. The distance X is less than the axial distance Z from the first end 26*a* of the port member to an end 79 of the gas inlet port 32 most distal the first end 26*a* of port member 26. Again the distance Z is measured along the central axis of the port member. With reference to FIG. 2, the opening 51 (more particularly the midpoint of the opening 51), in the circumferential direction of rotation, is A degrees from the closing end 34 of the gas inlet port 32. It is B degrees from the beginning end 37 of the gas discharge port 36. Preferably A is greater than B. Preferably A is 2 times B±0.2. In the shown example A is 66 degrees±5 degrees and B is 32 degrees±5 degrees.

The diverter has a first length from one end to an opposite end measured in the circumferential direction preferably the same as or about the same as the width of the sealing liquid introduction channel measured in the circumferential direction at the rim of the sealing liquid introduction port 60 opening through the exterior surface 30*b* of the first sidewall 30. The length should be at least the 0.5 times the width of the sealing liquid introduction port. The diverter should have a closest distance d measured along a radius of the central axis of the port member. The distance d should be greater than the inner radius r of the second sidewall. The distance d is about 1.22 times r±0.02.

A surface 81 of a filling 82 delimits said anti-cavitation passage 50 and thus said passage is open to said surface 81 of said filling. The surface 81 thus forms a surface of said passage. The filling 82 can be a plug. The filling 82 fills at least a portion of a channel 85. The channel 85 having the filling 82 is in the additional structure 71. Exclusive of the filling 82, the channel 85 has an opening 85*a* which opens into said ant-cavitation passage 50 from said additional structure. The filling 82 fills the opening. The channel 85 also has an opening 85*b* through the surface of the additional structure. This opening 85*b* is not filled. The channel 85 is a locating channel provided in connection with providing the anti-cavitation passage 50.

In a preferred operating mode, the pump 10 operates as a vacuum pump that produces a low absolute pressure (high vacuum pressure) at the inlet 32 and discharges the pumped fluid at a higher absolute pressure (e.g., atmospheric pressure) at the discharge 36. During some operating conditions, the pressure within the bucket as it passes the inlet 32 closing end 34 is lower than the vapor pressure of the liquid that forms the liquid ring. This condition can result in boiling (i.e., the formation of bubbles) of the liquid. Sudden exposure of this boiling liquid to a high pressure region (such as atmospheric pressure at the discharge 36) can cause the sudden collapse (implosion) of the bubbles which can cause cavitation.

With reference to FIG. 2, the operation of the pump including the anti-cavitation device is best understood. FIG. 2 illustrates multiple positions of buckets delineated by several radial broken lines. Each bucket rotates through multiple positions with positions G, H, I, J, K, and L being identified for description. A bucket begins its rotational cycle in position G. In this position, the bucket is closed to both the discharge opening 36 and the inlet opening 32 and is rotating in a clockwise direction as shown in FIG. 2. In position G, the liquid ring is at or near its closest approach to the shaft such that the volume of the bucket is at or near its minimum. Further rotation positions the bucket in position H. In this position, the bucket is open to the inlet opening 32 and the volume of the bucket is increasing as the liquid ring recedes from the shaft. The increasing volume draws fluid into the increasing volume. Further rotation positions the bucket in position I. In this position, the bucket is again closed to both the inlet 32 and the discharge 36. In addition, in position I, the liquid ring is at or near its maximum distance from the rotor such that the volume of the bucket is at or near its maximum. It is at position I where the bucket is at its lowest pressure (highest vacuum pressure) and the formation of bubbles is most likely. Continued rotation positions the bucket in location "J". As the bucket approaches this position, the liquid ring is moving toward the shaft to reduce the volume and increase the pressure within the bucket. Once in position "J", the bucket is open to the anti-cavitation opening 51. The anti-cavitation opening 51 is fluidly coupled to a source of relative high pressure (e.g., atmospheric pressure) and admits a volume of high pressure fluid into the bucket. The anti-cavitation opening 51 or the fluid path is sized to control the quantity of fluid admitted into the bucket to slowly increase the pressure in the bucket. The bucket then rotates to position K where it is open to both the anti-cavitation opening 51 and the discharge opening 36. At this point fluid is free to enter the bucket to increase the pressure to atmospheric pressure. The bucket eventually rotates to position L where the volume is substantially at atmospheric pressure and the volume is reducing as the liquid ring moves closer to the shaft and the bucket volume is reduced. Finally, the bucket returns to position G and the process begins again. The admission of high pressure fluid via the anti-cavitation inlet prior to exposing the bucket to the discharge 36 allows for a more gradual increase in the pressure within the bucket which allows any bubbles to dissipate more slowly, thereby reducing the likelihood of cavitation damage.

To manufacture the port member 26 the first sidewall 30 and the second sidewall 24 of said port member 26 are provided. The gas inlet port 32 and gas discharge port 36 are provided in the first sidewall 30. The sealing liquid introduction port 60 is provided in the first sidewall 30. The sealing liquid channel 61 has the walls 63 angled relative to the plane 67. The additional structure 71 is provided to extend a length less than the length of the discharge port 36. The above features can be provided by way of casting in combination with machining.

The first portion 53 of the channel of the anti-cavitation passage is provided in the additional structure 71 to have the entry 52 into the anti-cavitation passage. The locating channel 85 is provided in the additional structure 71 to open into the first portion 53 and to open through a surface of the additional structure 71. The second portion 55 of the channel is provided to have the opening 51 of the anti-cavitation passage 50 and to open into the first portion 53. The opening 85*a* of the locating channel open to the first portion 53 is filled with filling 82. The first 53 and second portion 55 and location channel 85 are machined into the port member 26 after it has been cast or otherwise formed.

The pump 10 can have a chamber housing 16 that has a circular inner surface delimiting a chamber 14. In this case the compressor package is a single lobe design having a single intake zone and compression zone. The pump could be a multiple lobe design. In this case the working chamber housing 16 would have an oval inner surface delimiting an oval chamber 14. The chamber would have two intake zones and two compression zones in an alternating pattern. The two intake zones would be on opposite ends of the minor axis of the oval and the two compression zones would be on opposite ends of the major axis.

The term gas as use herein is broad enough to include, without limitation, ambient air, fluids in a gaseous state other than ambient air, mixtures of gases, other than ambient air, with ambient air and/or non-ambient gases, and mixtures of incompressible and compressible fluids, vaporized liquids mixed with ambient air; and vaporized liquids.

Various features and advantages of the invention are set forth in the following claims.

What is claimed is:

1. A liquid ring pump comprising:

a pump head having an inlet opening, an outlet opening, and an anti-cavitation opening;

a pump housing coupled to the pump head and defining a chamber that is substantially enclosed by the pump housing and the pump head;

a rotor at least partially disposed in the chamber;

a port member disposed in the chamber and positioned adjacent the rotor, the port member including a wall that defines an inlet port, a discharge port, and an anti-cavitation port each separate from the others; and a plurality of blades arranged around a rotational axis of the rotor, wherein each pair of adjacent blades partially define a bucket therebetween, and wherein each bucket rotates from a first position in which the bucket is positioned between the discharge port and the inlet port, to a second position in which the bucket is in fluid communication with the inlet port to draw fluid into the bucket, to a third position in which the bucket is in fluid communication with the anti-cavitation port to admit fluid, to a fourth position in which the bucket is in fluid communication with the anti-cavitation port and the discharge port, and to a fifth position in which the bucket is in fluid communication with the discharge port to discharge the fluid within the bucket.

2. The liquid ring pump of claim 1, wherein the rotor defines a conical interior space.

3. The liquid ring pump of claim 2, wherein the port member wall is a conical outer wall and is at least partially disposed within the conical interior space.

4. The liquid ring pump of claim 1, further comprising a liquid disposed within the chamber, the liquid cooperating with the port member and the plurality of blades to enclose each of the buckets.

5. The liquid ring pump of claim 4, wherein a volume of each bucket expands due to movement of the liquid away from the shaft with respect to the blades during movement of each bucket from the second position toward the third position.

6. The liquid ring pump of claim 4, wherein the pressure within each bucket when in the second position is a first pressure and the pressure within each bucket when the bucket is in the fifth position is a second pressure that is greater than the first pressure, and wherein a fluid supply provides fluid to the anti-cavitation port at a third pressure that is between the first pressure and the second pressure.

7. The liquid ring pump of claim 6, wherein the pressure within each bucket when in the third position is greater than the first pressure and less than the second pressure.

8. The liquid ring pump of claim 1, further comprising a liquid introduction port formed in the wall of the port member, the liquid introduction port being positioned between a closing end of the inlet port and an opening end of the discharge port.

9. The liquid ring pump of claim 8, wherein said port member includes a diverter proximate the sealing liquid introduction port.

10. The liquid ring pump of claim 9, wherein the diverter has a first length from one end to an opposite end measured in the circumferential direction of rotation of about the same as a width of the sealing liquid introduction port measured in the circumferential direction.

11. A liquid ring pump comprising:

a pump housing defining a chamber that is substantially enclosed and that contains a quantity of liquid;

a rotor at least partially disposed in the chamber the rotor including a shaft supported for rotation about a rotational axis and a plurality of blades extending radially from the shaft, the plurality of blades defining a conical interior space; and a port member disposed at least partially within the conical interior space, the port member defining an inlet port in fluid communication with a low pressure region, a discharge port in fluid communication with a high pressure region, and an anti-cavitation port in fluid communication with a fluid supply having a pressure between the low pressure region and the high pressure region, the plurality of blades arranged such that each pair of adjacent blades cooperates with the liquid and the port member to substantially enclose and define a variable volume bucket, wherein rotation of the rotor selectively positions a first bucket of the plurality of buckets in an inlet position adjacent the inlet port to draw low pressure fluid into the bucket, in an anti-cavitation position wherein the bucket is adjacent the anti-cavitation port and fluid is admitted into the first bucket, and a discharge position wherein the first bucket is positioned adjacent the discharge port to discharge fluid from the bucket to the high pressure region, wherein the bucket is in an intermediate position between the anti-cavitation position and the discharge position such that the bucket is in fluid communication with the anti-cavitation port and the discharge port.

12. The liquid ring pump of claim 11, wherein the pressure within the first bucket when in the inlet position is a first pressure and the pressure within the first bucket when the bucket is in the discharge position is a second pressure that is greater than the first pressure, and wherein a fluid supply provides fluid to the anti-cavitation port at a third pressure that is between the first pressure and the second pressure.

13. The liquid ring pump of claim 12, wherein the pressure within the first bucket when in the anti-cavitation position is greater than the first pressure and less than the second pressure.

14. The liquid ring pump of claim 11, further comprising a liquid introduction port formed in the port member, the liquid introduction port being positioned between a closing end of the inlet opening and an opening end of the discharge opening.

15. The liquid ring pump of claim 14, wherein the port member includes a diverter proximate the sealing liquid introduction port.

16. The liquid ring pump of claim 15, wherein the diverter has a first length from one end to an opposite end measured in the circumferential direction of rotation of about the same as a width of the sealing liquid introduction port measured in the circumferential direction.

17. A method of reducing cavitation in a liquid ring pump comprising:

defining a plurality of buckets between adjacent blades of a rotor;

forming a liquid ring around the blades, the liquid ring and the blades cooperating to enclose each of the buckets such that as the buckets rotate about a rotational axis the volume within each bucket varies as a result of movement of the liquid ring with respect to the rotor;

rotating a first of the plurality of buckets to a closed position wherein the bucket is substantially sealed and the volume of the bucket is at a minimum volume;

rotating the first of the plurality of buckets to an intake position in which the bucket is in fluid communication with an inlet port;

maintaining fluid communication between the first bucket and the inlet port during further rotation of the bucket during which the liquid ring moves radially away from the rotational axis with respect to the first bucket to expand the volume of the first bucket and draw fluid into the volume via the inlet port;

rotating the first of the plurality of buckets to an anti-cavitation position wherein an anti-cavitation port is in fluid communication with the first bucket;

admitting a flow of fluid into the first bucket via the anti-cavitation port to increase the pressure within the first bucket;

rotating the first of the plurality of buckets to an intermediate position between the anti-cavitation position and a full discharge position such that the bucket is in fluid communication with the anti-cavitation port and a discharge port;

rotating the bucket to a full discharge position in which the first bucket is in fluid communication with the discharge port and is not in fluid communication with the anti-cavitation port; and maintaining fluid communication between the first bucket and the discharge port during further rotation of the first bucket during which the liquid ring moves radially toward the rotational axis with respect to the first bucket to reduce the volume of the first bucket and discharge fluid from the volume via the discharge port.

18. The method of claim 17, wherein a pressure in the first of the plurality of buckets is a first pressure when the first bucket is in the intake position and is a second pressure when the first bucket is in the full discharge position, the second pressure being greater than the first pressure.

19. The method of claim 18, further comprising directing the flow of fluid from a source to the anti-cavitation port, the source having a third pressure that is between the first pressure and the second pressure.

20. The method of claim 18, wherein directing the flow of fluid into the first bucket via the anti-cavitation port increases the pressure within the first bucket to a pressure that is greater than the first pressure and less than the second pressure.

* * * * *